United States Patent [19]

Garofalo

[11] 4,084,460

[45] Apr. 18, 1978

[54] HAND HELD NUT RUNNING AND CRIMPING POWER TOOL

[76] Inventor: Nicholas J. Garofalo, 259-09 81st Ave., Floral Park, N.Y. 11004

[21] Appl. No.: 774,513

[22] Filed: Mar. 4, 1977

[51] Int. Cl.[2] ..... B25B 23/00

[52] U.S. Cl. ..... 81/10; 29/240; 72/391; 72/453.15

[58] Field of Search ..... 81/10, 53; 29/283.5, 29/240; 72/453, 391

[56] References Cited

U.S. PATENT DOCUMENTS

| | | | |
|---|---|---|---|
| 3,478,564 | 11/1969 | Hurd | 72/391 |
| 3,646,837 | 3/1972 | Reynolds | 81/10 |
| 3,653,802 | 4/1972 | Weiss | 29/240 |
| 3,722,329 | 3/1973 | Van Hecke | 81/10 |
| 3,758,938 | 9/1973 | Simmons | 81/10 X |
| 3,797,335 | 3/1974 | Amtsberg | 81/10 |

*Primary Examiner*—Harold D. Whitehead
*Assistant Examiner*—Nicholas P. Godici
*Attorney, Agent, or Firm*—Nicholas J. Garofalo

[57] ABSTRACT

An air powered hand tool having combined therein nut running and crimping mechanism in which a common cam member is motor rotated to effect run down of a work nut about a stud and is piston driven to effect crimping of the nut in locking relation to the stud; in which an indicator visually indicates to the operator completion of the crimping action; and in which a stop prevents frictional locking of the cam member in the crimping action; and in which the stud is enabled to rise a considerable distance above the nut as the latter is run down.

8 Claims, 5 Drawing Figures

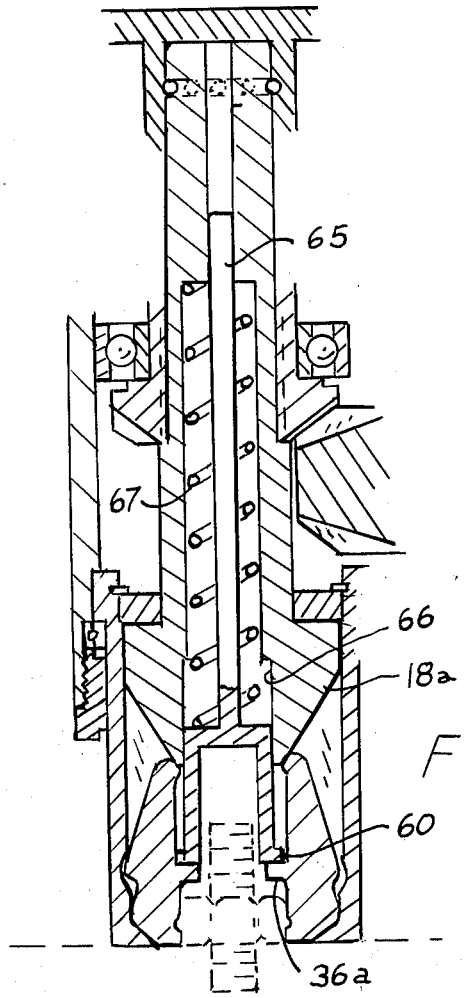
FIG. 5
FIG. 4
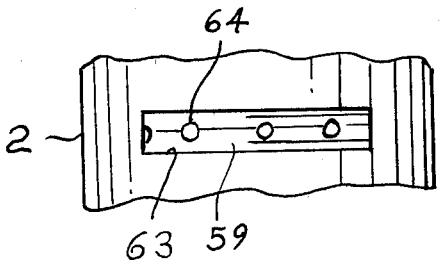

HAND HELD NUT RUNNING AND CRIMPING POWER TOOL

BACKGROUND OF THE INVENTION

This invention is directed to a portable hand held air powered tool having combined therein nut running and crimping mechanism, whereby a work nut is caused in one stage of operation of the tool to be run down to a predetermined degree of tightness about a threaded stud, and in a second stage of operation the nut is caused to be crimped into locking relation with the stud.

A tool of this general nature is known from U.S. Pat. No. 3,646,837 in which a nut receiving socket assembly is mounted externally of the main housing of the tool upon a projecting motor driven spindle for run down of a work nut in a first stage of operation; and within the assembly a piston powered cam is actuable in a second stage of operation relative to a group of levers to effect a crimping action upon the work nut.

A fault of this external rotatable socket arrangement is that it may prove hazardous and unsafe, in that a finger of the operator's hand may accidentally become pinched between the main housing of the tool and the rotating socket assembly. Similarly, there is the possibility of a piece of the operator's clothing or other loose element becoming caught and tangled in the rotating socket assembly.

Another apparent fault of this known tool lies in the threaded relationship of the rotatable socket assembly to the projecting spindle. This would be subject to considerable reaction torque forces during the final stage of a nut tightening operation which might strip the threading or otherwise damage the tool.

Accordingly, a general object of this invention is to provide an improved hand held air powered tool having combined nut running and crimping mechanism which avoids the faults of the known tool referred to.

In accordance with the invention there is provided a hand held portable tool comprising a housing, a group of levers supported in the housing, the levers having a normal position in hexagonal array defining a hexagonal opening adapted to slidably receive a hexagonal work nut, the levers being adapted for rotation to carry the received nut around with them, the levers also being pivotable from the normal position inwardly of the opening to effect a crimping action upon the side faces of the received nut, a cam member having rotatable and axial movement in the housing, means for transmitting rotation of the cam member to the levers, means for translating the axial movement of the cam member into pivotable movement of the levers, air motor means for transmitting rotation to the cam member, air powered piston means for imparting axial movement to the cam member, and control means selectively operable for causing application of operating air to either the motor means or to the piston means.

BRIEF DESCRIPTION OF THE DRAWING

In the accompanying drawing:

FIG. 4 is a detail view showing the adjustable stop plate and the associated access slot; and FIG. 5 is a fragmentary sectional view of a modified form of the invention in which a spring loaded plunger arrangement is substituted for the garter spring of the FIG. 1 embodiment for biasing the levers to normal position.

DESCRIPTION OF PREFERRED EMBODIMENT

Figures 1, 2, 3:
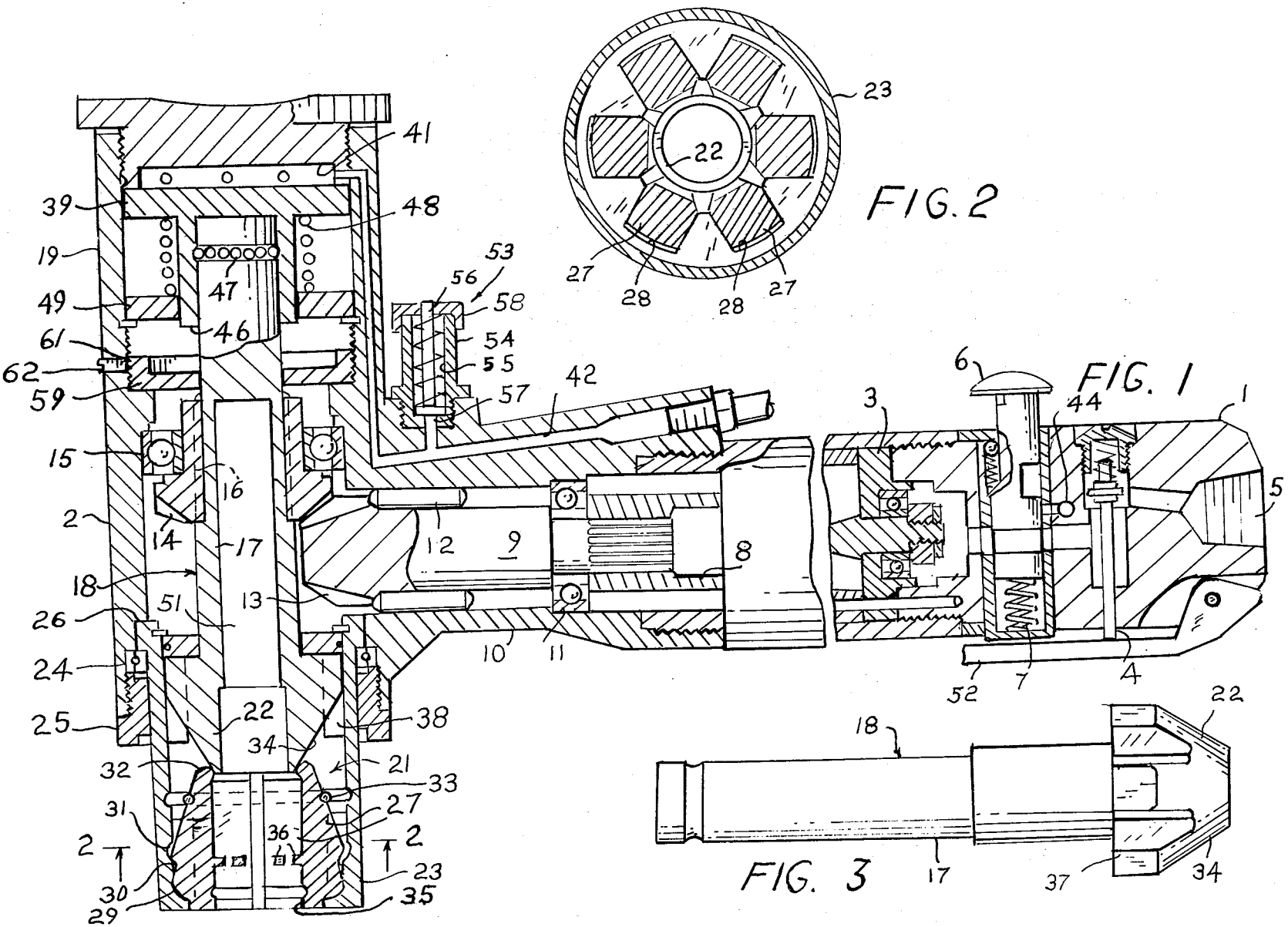
FIG. 1 is a view in longitudinal section of a nut runner embodying the invention.
FIG. 2 is a cross section on line 2—2 of FIG. 1.
FIG. 3 is a detail view of the cam member.

The invention will now be described with reference to the accompanying drawing sufficiently and in such concise manner as to enable persons having ordinary skill in the art to understand and use the invention.

The portable hand tool shown in the drawing as illustrating an embodiment of the invention includes a general housing having a main or handle section 1 to the forward end of which an angle head section 2 is coupled.

Supported in the main housing is a conventional rotary air driven vane motor 3. A manually operable throttle valve 4 is arranged in the housing to control flow of operating pressure air from a supply inlet 5 to the motor. A manually operable directional valve 6, located between the throttle valve and the motor, has a normal position under the bias of a return spring 7, as in FIG. 1, in which air fed to it from the throttle valve is directed through housing passages to the motor.

Rotation of the motor is transmitted through conventional reduction gearing, a small part of which is indicated at 8, to drive a spindle 9. The latter extends into an arm 10 of the angle head where it is supported in suitable bearings 11, 12.

Spindle 9 carries a beveled pinion 13 which drivingly engages a beveled sleeve gear 14. The latter is rotatably supported by means of its extended body in bearing means 15; and it has an internal sliding spline drive connection 16 with an elongated stem portion 17 of a cam member, generally designated 18. The spline connection 16 enables the sleeve gear to rotate the cam member; and also enables the cam member to slide axially relative to the sleeve gear.

The cam member extends axially of a second arm 19 of the angle head; and it is common to or a component of a combined nut running and nut crimping mechanism, generally indicated 21, housed in arm 19.

The cam member has at its lower end a camming head 22 which depends into a rotatably supported holding sleeve 23.

The holding sleeve projects in part, as in FIG. 1, from an open bottom end of the angle head. It is rotatably supported about its upper end in bearing means 24. A ring nut 25 threaded into the bottom end of the angle head supports the bearing in place and serves to present a relatively broad inner bearing face to the holding sleeve. A housing shoulder 26 overlying the upper annular end wall of the holding sleeve, in conjunction with the bearing means 24, restrains the holding sleeve against relative axial movement.

The holding sleeve has an open bottom end adjacent to which it supports a group of internally located levers 27. The levers are six in number; and they are spaced circumferentially equally apart. The several levers, as will be described herein, are in one stage of operation of the tool rotatable as a unit to effect rotation and rundown of a work nut received between them upon an associated stud; and the several levers are pivotable relative to the nut in a second stage of operation to effect a crimping action upon the side faces of the nut with consequent deformation of the threads of the nut so as to lock the nut to the stud.

Each lever is of a general triangular configuration; and it is disposed in an individual guide channel 28 formed in the inner wall of the holding sleeve. Each lever has at the bottom of its back wall a rounded corner or heel 29 which seats and is pivotable upon an inside radius at the bottom of the channel. The back wall of each lever is offset at 30 a little above the heel portion adjacent a cavity 31 at the back of the channel, and inclines upwardly toward a rounded vertex tip 32. The rounded vertex ends of the several levers are constantly held in pressed abutment with a lower coned terminal surface 34 of the camming head by means of a garter spring 33.

In the normal position of the several levers, as in FIG. 1, the inner walls of the several levers have a vertical arrangement in hexagonal array. At the lower end of each of the inner walls of the levers is a jaw 35. The several jaws present in the normal position of the levers an hexagonal opening into which a nut intended to be tigthened upon a stud may be slidably received. A bead 36 on the inner face of each lever just above the jaw portion provides a stop or seat limiting the extent to which a nut may be entered upwardly between the jaws.

The upper portion of the camming head 22 has a splined periphery, each spline 37 of which projects into a separate spline track 38 at the upper internal area of the holding sleeve. This splined arrangement enables transmission of rotation of the cam member to the holding sleeve. As the latter rotates it carries the several levers with it, and thereby causes a nut received between the jaws to be set or rundown upon an associated threaded stud.

The sliding spline arrangement of the camming head with the holding sleeve also enables the camming head, when forced downwardly over the rounded vertex ends 32 of the several levers, to pivot the levers so as to force their upper ends radially outward against the resistance of the garter spring. In this action the several jaws move radially inward against the side faces of the nut. The pressure exerted by the camming head through the levers is forceful enough to cause the jaws to bite into the nut sufficiently to deform the threads of the nut relative to those of the stud so as to lock the nut and stud together.

To effect the biting or crimping action of the jaws upon the nut, axial movement is caused to be imparted to the cam member 18 by means of a pneumatically powered overhead piston 39.

The piston is operable in a chamber 41. The latter connects through a housing passage 42 and an external tube with a side port 44. The side port is normally blocked from receiving air from the throttle valve 4 by means of the normal position of the directional valve 6, as appears in FIG. 1. When the directional valve is manually depressed against the load of its return spring, subsequent actuation of the throttle valve causes operating air to be directed through the side port to operate the piston against the cam member.

The piston has a depending sleeve portion 46 into which the upper tail end of the stem 17 of the cam member is slidably received. A ring of ball bearings and groove means at 47 retains the piston to the cam member so as to enable the latter to be moved downwardly by the piston and returned. The ball bearings and groove means also allows rotation of the cam member relative to the piston.

A spring 48 serves to return the piston and cam member to raised position following a work stroke of the piston. The spring is limited between the underside of the piston and a ring plate 49.

In summary of the operation of the tool, the operator positions the holding sleeve end of the tool down over the work nut so as to receive the latter into the hexagonal opening between the jaws. The internal beads 36 provide a seat for the nut. The vacant area between the levers together with the hollow interior of the cam member allows the upper end of a threaded stud to ride therein as the nut is run down upon the stud. The hollow interior 51 of the cam member is adequate to receive a stud portion of considerable length.

Next, the operator depresses the throttle valve by means of the hand lever 52, causing operating air to flow through the directional valve 6 to drive the motor. The motor torque is transmitted through spindle 9 and gearing 13, 14 to rotate the cam member 18 and the holding sleeve, causing the several levers 27 to run down the work nut about the associated stud. When the nut has been torqued to or reached a predetermined degree of tightness, the motor is adapted to stall. The operator may then remove the tool from the work; or he may elect to crimp the nut into locking relation to the stud.

To effect the crimping action, the operator manually depresses the directional valve while holding the throttle valve open. Operating air is then directed by the directional valve to the piston causing the cam member to cam the several levers 27 in a crimping action against the nut. Following the latter action the operator releases the directional and throttle valves, permitting the return spring 48 to return the piston and cam member to normal. The piston chamber 41 vents through a suitable vent, not shown, in the directional valve as the piston returns.

While a skilled operator could develop a feel for the tool and sense when the tool has completed its crimping action, nevertheless indicator means, shown at 53, is incorporated into the tool as a convenience to this end. It will visually indicate to the operator, whether he be skilled or not, precisely when the crimping action has been completed.

The indicator means 53 includes a bushing body 54 threaded into a bore of the angle head section of the housing. The bushing has a plunger chamber 55 which connects by means of a port at its bottom with the air feed passage 42 that leads to the piston chamber. A plunger 56 is normally seated by means of a spring load over the port 57. A cap 58 closes over the top of the plunger chamber. It provides an axial opening through which the plunger rod may be projected following development of a predetermined value of back pressure in the air feed passage 42. When the plunger rod has been projected externally of the cap, as will be indicated by coloring or other suitable marking on the rod, it will be a signal to the operator of the extent of the crimping action.

The indicator means 53, as appears in FIG. 1, has been located at the junction of the arms of the angle head section of the housing. In this place it will not normally interfere with maneuvering of the tool and will be protectively guarded by its particular location against damage.

It can be appreciated that it is desirable in a crimping operation to curb the extent of downward movement of the camming head 22 relative to the levers 27. This curbing is desirable so as to avoid the possibility of the camming head and levers becoming frictionally locked with the holding sleeve, and also to reduce undesirable wear and tear on the cooperating elements. To this end an adjustable ring nut stop plate 59 is provided.

The stop plate 59 has a peripheral threaded engagement at 61 with the housing. It may be adjusted upwardly or downwardly as needed relative to the lower end of the depending sleeve portion 46 of the piston. The stop plate freely surrounds the stem of the cam member 18 so as not to interfere with movements of the latter. In its adjusted position the upper surface of the stop plate is cooperable with the piston sleeve to precisely limit the extent of downward movement of the piston and as a consequence the downward movement of the camming head relative to the levers 27.

A set screw 62 serves to secure the adjusted position of the stop plate. A circumferentially extending slot 63 in the housing permits access of a suitable wrench to a succession of holes 64 in the periphery of the stop plate so as to enable the adjustment of the stop plate to be conveniently made from the outside of the tool.

In lieu of the garter spring 33 that serves to bias the levers 27 to their normal positions, a plunger 65 as shown in FIG. 5 may be utilized. The plunger is slidable in a hollow 66 of the cam member 18*a*. It has an annular foot 60 pressing under the bias of a spring 67 upon the internal beads 36*a* of the several levers, whereby the levers are constantly urged to their normal positions.

While an embodiment of the invention has been illustrated and described in detail, it is to be expressly understood that the invention is not limited thereto. Various changes of form, design or arrangement may be made in its parts without departing from the spirit and scope of the invention. It is my intention therefore, to claim the invention not only as shown and described but also in all such forms, modifications or equivalents thereof as might be reasonably construed to be within the spirit of the invention when considering the specification, drawing, and the appended claims.

What is claimed is:

1. A hand held portable tool comprising a housing, a group of levers supported in the housing, the levers having a normal position in hexagonal array defining a hexagonal opening adapted to slidably receive a hexagonal work nut, the levers being adapted for rotation to carry the received nut around with them, the levers also being pivotable from the normal position inwardly of the opening to effect a crimping action upon the side faces of the received nut, a cam member having rotatable and axial movement in the housing, means for transmitting rotation of the cam member to the levers, means for translating the axial movement of the cam member into pivotal movement of the levers, air motor means for transmitting rotation to the cam member, air powered piston means for imparting axial movement to the cam member, and control means selectively operable for causing application of operating air to either the motor means or to the piston means, wherein the cam member has a ball bearing and groove connection with the piston enabling the cam member to have rotation relative to the piston and to have axial movement as a unit with the piston.

2. A hand held portable tool as in claim 1, wherein a ring plate having a threaded connection with the housing is disposed below the piston and is adjustable relative to the housing and to the piston to predetermine the extent of axial movement of the piston.

3. A hand held portable tool as in claim 2, wherein a circumferentially extending slot is provided in the housing in register with the periphery of the ring plate, and means is provided in the periphery of the ring plate to which access from the outside of the tool may be had through the slot for effecting adjustment of the ring plate.

4. A hand held portable tool as in claim 1, wherein the control means includes a manually operable throttle valve and a manually operable directional valve, the directional valve having a normal condition in which it is adapted to direct operating air from the throttle valve to the motor means, and the directional valve having an actuated condition in which it is adapted to direct operating air from the throttle valve to the piston means.

5. A hand held portable tool as in claim 4, including means for visually indicating the extent of the crimping action comprising a plunger connected in an operating air conducting passage leading from the directional valve to the piston, the plunger being extensible to the outside of the housing in response to development of a predetermined value of air pressure in the passage during the crimping action.

6. A combined nut running and crimping tool comprising within a housing a fluid powered motor, a fluid powered piston, manipulative valve means controlling fluid flow to the motor and to the piston selectively operable to direct fluid flow to either the motor or to the piston, nut running means rotatable to run down a work nut, nut crimping means pivotable to effect a squeezing action upon the work nut, a cam member connected to transmit rotation of the motor to the nut running means, and the cam member being arranged to transmit movement of the piston into pivotal movement of the crimping means, wherein the cam member has a ball bearing and groove connection with the piston enabling the cam member to have rotation relative to the piston and to have axial movement as a unit with piston.

7. A combined nut running and crimping tool as in claim 6, wherein a group of levers is common to the nut running means, the levers having a normal position in hexagonal array defining an hexagonal opening adapted to receive slidably a work nut, and the levers being adapted when rotated as a group in the normal position to effect run down of the work nut.

8. A combined nut running and crimping tool as in claim 7, wherein the levers are pivotable from the normal position into squeezing relation with the nut.

* * * * *